United States Patent [19]

Jordan

[11] Patent Number: 4,714,066

[45] Date of Patent: Dec. 22, 1987

[54] FUEL INJECTOR SYSTEM

[76] Inventor: Robert D. Jordan, 885 Carthage Ct., Concord, Calif. 94578

[21] Appl. No.: 178,142

[22] Filed: Aug. 14, 1980

[51] Int. Cl.[4] ..... F02M 39/00

[52] U.S. Cl. ..... 123/447; 239/88; 417/277; 123/496; 123/25 A; 123/357

[58] Field of Search ..... 123/25 A, 35, 7-359, 123/508, 496, 590, 447, 497, 503; 239/90, 88, 89, 91-95; 417/277; 92/60.5

[56] References Cited

U.S. PATENT DOCUMENTS

| | | | |
|---|---|---|---|
| 1,616,987 | 2/1927 | Prellwitz | 417/277 |
| 2,530,128 | 11/1950 | Mashinter | 239/88 |
| 4,029,071 | 6/1977 | Saito | 123/447 |
| 4,047,507 | 9/1972 | Noguchi | 123/357 |
| 4,055,387 | 10/1977 | Potter | 123/450 |
| 4,069,794 | 1/1978 | Jordan | 123/25 A |
| 4,337,839 | 7/1982 | Taplin | 123/357 |
| 4,526,149 | 7/1985 | Häfele | 123/447 |
| 4,554,903 | 11/1985 | Straubel | 123/447 |
| 4,591,321 | 5/1986 | Devaux | 123/447 |

*Primary Examiner*—Carl Stuart Milles

*Attorney, Agent, or Firm*—Bielen and Peterson

[57] ABSTRACT

An injector system for injecting fuel and/or water into the combustion chamber of an engine cylinder having a high pressure pump with a primary piston for pumping fluid to an injector nozzle and plurality of integral control cylinders having means for discretely controlling the displacement of pistons in the control cylinders for altering the effective volume of fluid pumped by the primary cylinder, the fluid pumped hydraulically displacing an injector piston in the injector nozzle for displacing a nozzle discharge stem allowing a divergent spray of fuel and or water to enter the combustion chamber, wherein the high pressure pump includes an associated regulating mechanism for displacing at least one control cylinder piston according to an input derived from the operator's power demand and the engine r.p.m.

5 Claims, 4 Drawing Figures

FUEL INJECTOR SYSTEM

BACKGROUND OF THE INVENTION

This invention relates to an improved liquid injector system particularly designed to maximize the efficiency of the fuel delivery and combustion process. The injector system is particularly applicable to internal combustion engines of the type described in my patent entitled, Positive Power Control Internal Combustion Engine, U.S. Pat. No. 4,069,794, issued Jan. 24, 1978, and incorporated herein by reference.

As operating requirements for internal combustion engines become increasingly stringent, both as to fuel efficiency and emission control, the fuel delivery and combustion process must be more closely monitored and regulated.

The improvements disclosed herein are directed to advances in the fuel delivery system which enable increased regulation of the combustion process through the application of feedback links from environmental conditions and operator controls. To incorporate such feedback links, the fuel delivery system is improved from prior systems by its ability to accomodate and respond to multiple inputs from a variety of sources. For example, the quantity of fuel delivered to a fuel injector in the system devices is independently regulated according to air pressure and temperature, engine operating temperature and uniquely, a power demand-/engine r.p.m. differential signal. In an engine of the type disclosed in the referenced patent the combustion temperature is controlled within limits by water injection utilizing components similar in construction and operation to the fuel delivery system. For purposes of the detailed description, the embodiment of the fuel delivery system described, is structurally equivalent to the water injection system where it is desired that a quantity injection of water be determined by multiple input factors.

In the present invention, the differential of the power demand and the engine r.p.m. is an important input to the fuel delivery system. This input regulates the amount of fuel supplied to the combustion cycle according to a comparison of the actual angular velocity of the engine with that required by the operator as indicated by his vehicle speed demand. The operation's indication of vehicle speed demand is customerily imparted by the degree displacement of the gas peddle or accelerator. The comparison of the angular velocity with the effective linear velocity desired to produce a difference or differential is a more meaningful indication of the real fuel requirement than is a simple gas peddle displacement. For example, during a high speed decent down a hill, very little, if any, gas may be needed to maintain vehicle speed, whereas a conventional throttle system may be delivering an abundance of unnecessary fuel to combustion simply because the engine requires fuel to work against the throttle and friction produced by the action of the throttle.

The improvements of this invention are designed to further refine the fuel saving and pollution reduction of the engine disclosed in the referenced patent. However, the delivery system described has application to other engines where a similar objective is desired.

SUMMARY OF THE INVENTION

The liquid injector system of this invention comprises in its preferred embodiment a fluid injector and associated components designed to deliver a divergent spray of liquid in an amount defined by a plurality of operating variables.

In engines utilizing water injection, the mechanisms forming the described fuel injector system, which is the focus of the detailed descriptions, are adapted for use in a water injector system which may also have a variation in the amount of injected spray dependent on multiple variables, i.e. engine operating temperature, operating speed, and other conditions affecting optimum water injection.

In the preferred embodiment a fuel injector system is described with the inclusion of a power demand/engine r.p.m. differential input mechanism for primary regulation of fuel delivery to the injector unit of the injector system. The fuel injector system includes the injector unit which physically injects fuel into the combustion chamber of an engine, a hydraulic control pump which delivers controlled volumes of fluid to the injector unit and the differential input mechanism, which regulates the control pump according to operator demand and engine speed. The differential input mechanism can operate as a single unit controlling multiple control pumps where one control pump and injector unit is employed for each combustion cylinder of a multi-cylinder engine.

The fuel injector unit includes a modified nozzle configuraton to that described in the referenced patent, which is constructed to deliver a divergent conical spray to a combustion chamber. The divergent nature of the spray results in a fine particle spray on breaking of surface tensions as the conical film departs from the annular nozzle orifice. Since the amount of fuel is precisely tuned to the operating conditions and power requirements, a thorough, uniform dispersal within the combustion chamber is necessary to assure complete combustion.

The hydraulic control pump is improved over that disclosed in the referenced patent to include a multiple input control mechanism. It has been discovered that for maximum fuel efficiency a plurality of operating and environmental conditions should be considered and utilized as control inputs to determine efficient fuel delivery. The improved hydraulic control pump allows a plurality of independent inputs to be incorporated into the control mechanism which determines the quantity of fluid delivered to the injector unit. Each dependent input is operationally connected to a control cyclinder with a volume displacement piston. The control cylinders and volume displacement pistons cooperate with the hydraulic pump piston and pump chamber to regulate the flow of hydraulic pumping fluid to the fuel injector. As a result, the hydraulic pump regualtes the amount of fuel injected by the fuel injector.

The power demand/engine r.p.m. differential input mechanism, hereinafter the input differential mechanism, is a device that compares the power demand of the operator with the existing operating speed of the engine and generates a differential input signal. The generated differential input signal is utilized as the primary fuel flow regulator and is connected to one of the multiple control cyclinders of one or more of the hydraulic pumps.

The differential input signal in the preferred embodiment is generated mechanically by a centrifugal engine velocity monitor. The monitor develops a linear displacement in a linkage element proportional to the angular velocity of the engine. A similar linkage element is connected to the operator's manual control such as a conventional accelerator pedal and is imparted a linear displacement proportional to the power demand of the operator.

An interlinked differential mechanism generates an output displacement in a connected linkage element which imparts its displacement by a cam control to at least one piston of a control cylinder in a hydraulic pump.

As described for alternate embodiments, an electrical analog to the mechanical imput differential mechanisms can be provided to generate an electrical differential signal that can operate a stepping motor or other drive means to control displacement of the control cylinder piston in the pump.

These and other features of the invention will become apparent from a detailed consideration of the preferred embodiments.

BRIEF DESCRIPTION OF THE DRAWINGS

FIG. 1 is a cross sectional view of the hydraulic pump mechanism.

DETAILED DESCRIPTION OF THE PREFERRED EMBODIMENTS

Figure 2:
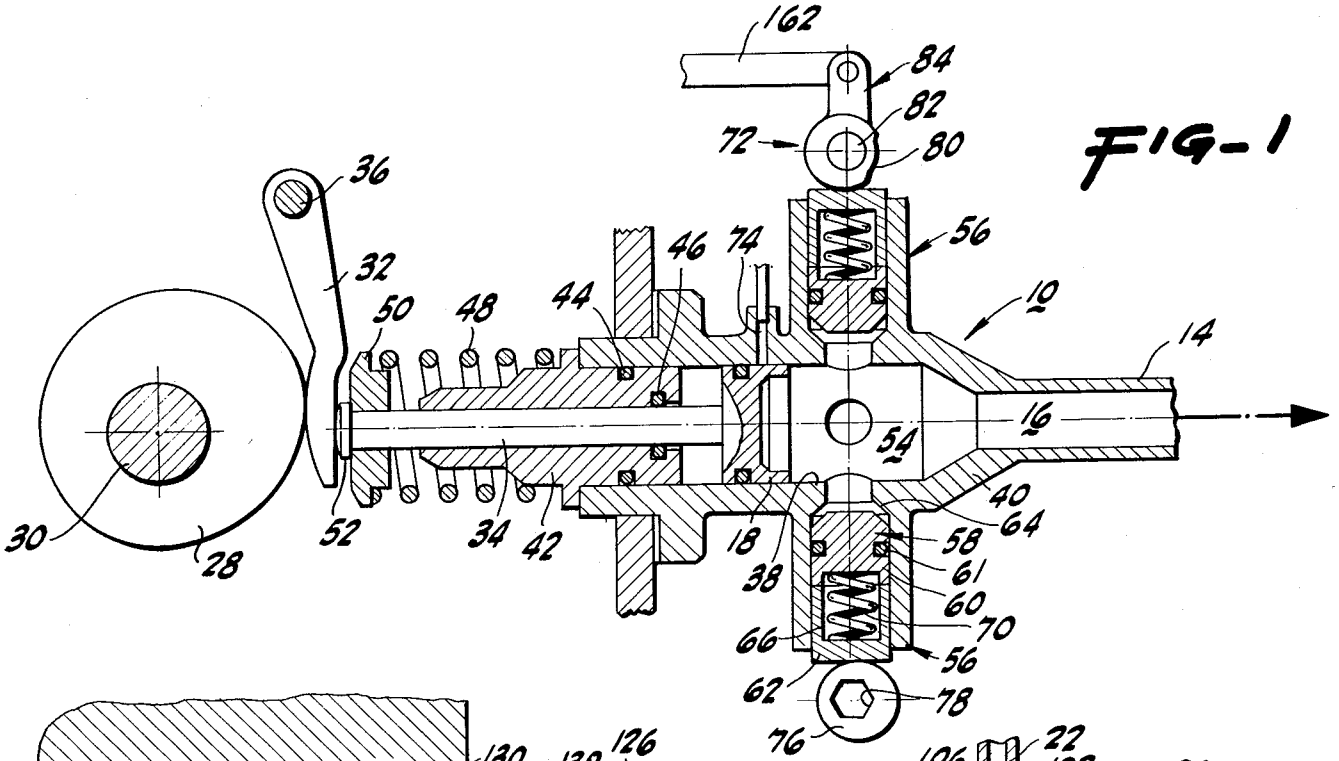
FIG. 2 is a cross sectional view of the fuel injector mechanism and a portion of an associated combustion chamber.

Referring to FIGS. 1 and 2, a hydraulic pump 10 and fuel injector 12 are respectively shown. The hydraulic pump 10 of FIG. 1 is connected by a high pressure conduit 14 to the fuel injector 12 of FIG. 2. Hydraulic fluid 16 from the pump operationally connects a pulsed drive piston 18 in the hydraulic pump to a power piston 20 in the fuel injector for periodic injection of fuel 22 into a combustion chamber 24 in accordance with an engine cycle.

While the described pump and injector system are particularly adapted to implementation on a two cycle engine as described in my referenced patent, the system can be adapted for use in a variety of engines designed for fuel injection systems or including water injection systems. In FIG. 1, the hydraulic pump 10 is mounted to an engine block 26 and operationally connected to a cam 28 mounted on a cam shaft 30 which preferably derives its power from a conventional crank shaft (not shown), through a suitable gear or chain coupling. The cam 28 is synchronized with the ultimate compression stroke of associated engine for timely injection of fuel into the combustion chamber 24 by the fuel injector 12. The cam 28 engages a cam follower 32, which in turn engages a piston push rod or stem 34 in the hydraulic pump 10. The cam follower 32 is an easily replaceable element mounted on pivot pin 36 connected to the engine block or head. The follower advantageously absorbs wear from the cam engagement and transmits forces from the cam 28 in a linear manner to the stem 34 of the drive piston 18.

The drive piston 18 of the hydraulic pump is reciprocally located within a bore 38 of a pump housing 40. The piston stem 34 is axially positioned by stem packing 42 with O-ring seal 44 and v-cup seal 46 at the interface of the bore 38 and stem 34, respectively. A compression spring 48 and split ring stem collar 50 fix the engagement of the packing 42 in the pump housing and provide a return bias to the piston 18 and connected stem 34 to maintain operational engagement of the contact cap 52 at the end of the stem with the cam follower 32 and ultimately the cam 28.

The cam drives the piston 18 in a reciprocating manner causing a fluid pulse to be transmitted from the pump to the injector via the interconnecting conduit 14. Interfacing a primary pump chamber 54 formed by the bore 38 are four control cylinders 56 symmetrically arranged around the periphery of the bore. The control cylinders 56 each include a fluid displacement unit 58. This unit comprises a control piston 60 with a v-cup seal 61 and a stop shell 62. The control pistons 60 are reciprocal between a shoulder 64 in the control cylinders and the stop shells. Largely contained within a hollow 66 in the stop shell and partially within a recess 68 in the piston is a compression spring 70 which biases the piston against the cylinder shoulder 64 and tends to separate the piston and stop shell.

The stop shell 62 is selectively positioned by a cam mechanism 72. Each cam mechanism is independently controlled and is designed for translating a select input to the hydraulic pump via the stop shell and control piston for regulating the amplitude of the fluid pulse. This is accomplished by the collapse of the control pistons from their advanced position against the cylinder shoulder to their retracted position against the stop shells during the pumping strike of the drive piston 18. At the beginning of the stroke the drive piston is retracted to a position allowing pump chamber 54 to communicate with a fluid replenishment orifice 74 which is turn communicates with an elevated fluid supply reservoir (not shown). At this position the fluid system is not under pressure and the compression springs of the fluid displacement units displace the control pistons to their shoulder position. As the pumping stroke begins and the drive piston eclipses the replenishment orifice the effective fluid volume is fixed. Because a pressure in excess of the bias effect of the compression springs in the fluid displacement units is developed in order to displace the power piston 20 of the fuel injector, the control pistons collapse to their respective stops as the drive piston progresses in its fixed stroke, thereby changing the effective volume of the hydraulic chamber and hence the resultant stroke of the power piston.

Each variation in the positions of the shell stops are summed for an overall volume displacement effect, thereby determining the power piston stroke in the fuel injector and consequently the amount of fuel injected.

In FIG. 1, two types of positioning means are shown for cam mechanism control. A periodically adjustable, static cam 76 maintains its adjusted position during operation of the pump. Adjustments are accomplished by rotation of the suitably mounted cam by use of an Allen wrench in axially located socket 78. This type of cam is used for adjustment in conditions that may be constant or of long duration. For example, one such static cam mechanism may be employed to factory tune the pump and associated injector such that a multi-cylinder engine has each pump and injector system tuned to the others. Another static cam may be used for geographic adjustment where atmospheric pressures due to elevation at locations primary use are considered. Another static cam, for added example, may be used for customary fuel types used.

The other type of cam mechanism is a continuously adjustable cam 80, which continuously during operation of the pump is variable in response to a manual input or automatic control. The cam 80 is rotatably connected to a shaft 82 and is rotated by a control linkage 84 in response to a mechanical control signal generated in response to a monitoring device. The control linkage may be replaced by a gear drive or other transmission means where an electrically operated device is employed, for example, a stepping motor.

Figure 3:
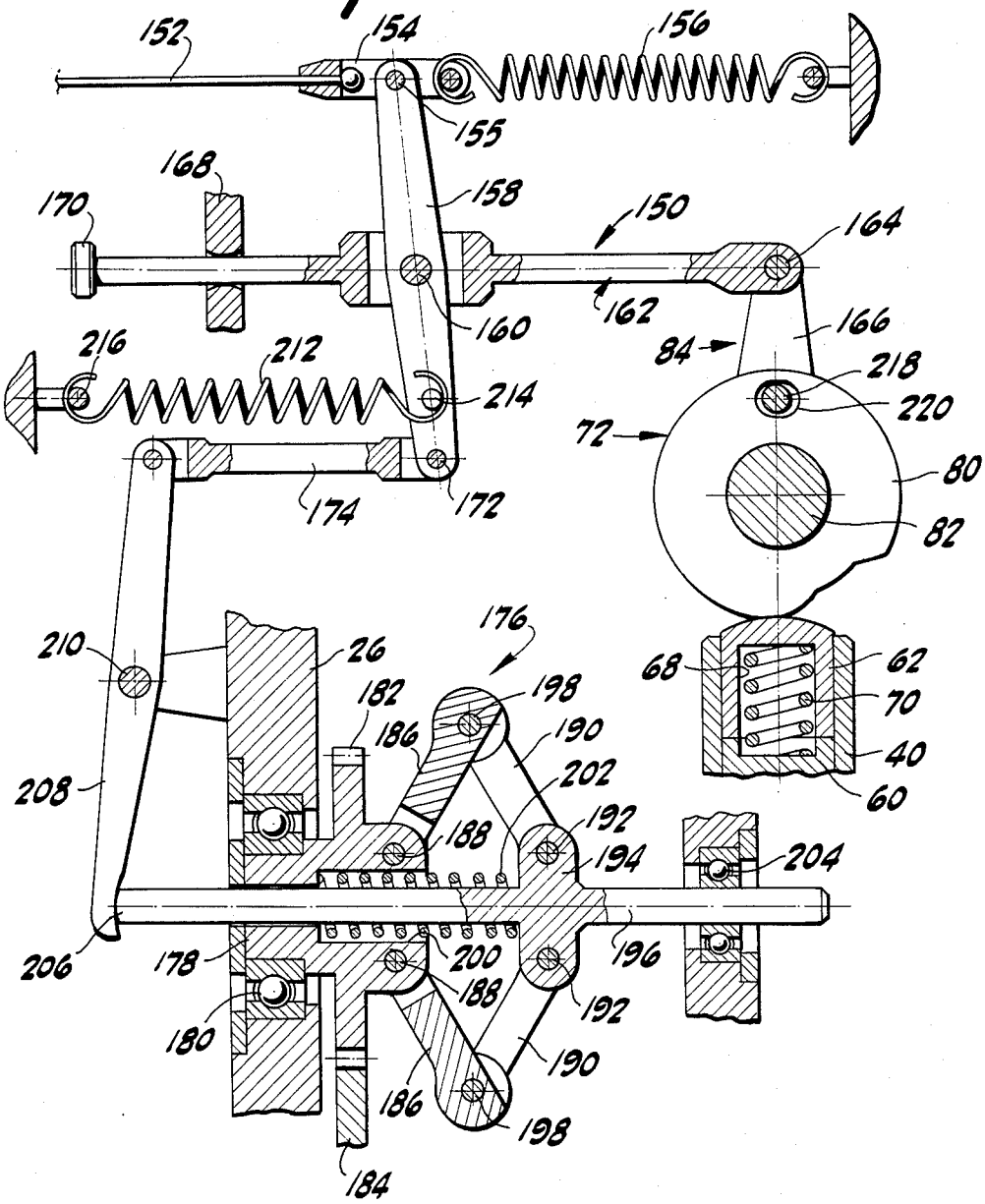
FIG. 3 is a schematic and cross sectional view of a control mechanism cooperable with said pump mechanism.

The particular cam 80 shown in FIG. 1 is designed for mechanical control by a connected mechanism, shown in FIG. 3, which generates a linear displacement from a power demand/engine r.p.m. differential input. This differential input essentially controls the operating speed of the associated engine by regulation of the fuel quantity pumped through the injector, as described in greater detail hereinafter.

Referring to FIG. 2, the fuel injector 12 is similar to the injector of the referenced patent except for substantial improvements in the nozzle end 86, which introduces the spray of fuel into the combustion chamber 24. The fuel injector 12 is constructed with an outer housing 88, threadably attached at its nozzle end to the engine block or head 90 and positioned for broad pattern dispersal of injected fuel spray into the engine combustion chamber 24. The housing is bored to provide a hydraulic fluid chamber 92 containing the power piston 20 and a fuel supply piston 94 which is a component part of a high pressure injection syringe 96. The power piston 20 is provided with double v-cup seals 98 to prevent leakage of hydraulic fluid from the hydraulic fluid chamber 92 to a fuel supply chamber 100 on the opposite side of the power piston 20.

Fuel enters the fuel supply chamber 100 through a fuel line orifice 102 under force of a lower pressure fuel pump. The fuel pressure is adequate to displace a check valve ball 104 against the bias of a compression spring 106 of low spring constant in the fuel supply piston. In this manner, fuel is able to enter a fuel injection cylinder 108 in the high pressure injection syringe 96 through passages 112 in the supply piston portion of the syringe. The injection syringe is slidable in the bore forming the hydraulic and fuel supply chambers under the advance contact force of the power piston 20 and retracting force of a compression spring 114. Any fuel that bypasses a v-cup seal 116 on the fuel supply piston 94 to the compression spring area is returned to the low pressure side of the fuel pump (not shown), through return orifice 118. The injection syringe has a hollow high pressure slide piston 120 which is slidable in the fuel injection cylinder 108 to transmit fuel to the final injector stage of the fuel injector at high pressures in the range of 1000 to 2000 psi. The long length and close tolerance of the slide piston and injection cylinder together with the cylinder located O-ring seal 122 prevent back flow of fuel.

A final check valve ball 124 and compression spring 126 of high spring constant prevent forward movement of fuel until a relatively moderate fuel pressure of approximately 100 psi is reached. The pressure charged fuel enters a discharge chamber 128 and advances a discharge stem 130 a minute increment to allow fuel to be discharged between the conical end 132 of the stem and the conical seat 134 of the nozzle passage 136. The thin divergent film breaks into a spray mist as it enters the combustion chamber 24.

The discharge stem 130 includes a threaded adjustment head 138 and stop collar 140 with holes 142 allowing free passage of fuel from one portion of the discharge chamber 128 to a second portion in which is located a bias spring 144 to seat the conical end 132 of the stem on the conical seat 134 when the high pressure injection process is not occurring. The adjustment head 138 is locked in place by brazing or other such means once the desired tolerance between the conical end and seat, for example, 0.002–0.003 inch is obtained. In addition to providing a divergent spray which breaks into small particles on injection, the nozzle design prevents escape of vaporized fuel at the nozzle site generated by the high local temperatures during the combustion process.

Referring now to FIG. 3, the mechanism is shown for generating the differential control signal for comparing engine angular velocity with the operator's demand. The resultant signal is employed to modulate the fuel feed to the injector and has its input at the hydraulic pump site. In the preferred embodiment of FIGS. 1 and 2, the continuously adjustable cam 80 connected to the control linkage 84 allows for input of the continuously modulated fuel feed signal. This signal is the primary control signal for vehicle velocity and provides an efficient substitute for the conventional throttle signal generated by operator manipulation of the accelerator. The r.p.m./demand mechanism, designated generally by the reference numeral 150 receives a linear input from the operator via a cable 152 which may be connected to an accelerator pedal or other manually operated control. A linear displacement in the cable 152 is in proportion to the increase or decrease in vehicle speed desired by the operator. The cable is connected to a pivot pin carrier 154 and is opposed by a return spring 156 allowing for a bi-directional displacement in a conventional manner. The pivot pin carrier 154 is connected by pin 155 to one end of a double input lever 158.

The input lever 158 is connected, substantially at its center, on pivot pin 160 to a linear output rod 162. The linear output rod 162 is connected at one end to a pivot pin 164 at the end of the arm 166 of the connecting linkage 84 to the control cam 80. The opposite end of the output rod 162 is slidably retained by a guide 168 for substantially linear displacements, and the end includes a stop 170 to prevent dislocation.

The opposite end of the double input lever 158 is pivotally connected on pin 172 to a link 174 that connects the output rod 162 to a speed monitoring device, designated generally by the reference numeral 176. The speed monitoring device comprises a conventional mechanical r.p.m. meter operationally similar to a flyball governor.

In the device shown, a hub 178 is mounted in a ball bearing 180 mounted in the engine block or other suitable accessory. The hub is provided with a peripheral sprocket or gear 182 for connection to a moving part of the engine, for example, the flywheel 184. Mounted to the hub is a centrifugally responsive link mechanism comprising first links 186, pivotally connected by pins 188 to the hub 178, and second links 190 pivotally connected at one end by pins 192 to a mount 194 on a slide rod 196 and at the other end by pins 198 to the first links 186. At the connection of the first and second links, the links are weighted. Located in a recess 200 in the hub 178 and biased against the linkage mount 194 on the slide rod 196 is a compression spring 202. The slide rod is journaled in a guide bearing 204 and allowed a degree of displacement along its axis while rotating with the hub 178 through which it is slidably engaged. As the hub and connected components rotate, the centrifugal forces affect the weighted outer ends of the links causing a scissor effect, displacing the rod mount closer to the hub. The centrifugally developed forces are resisted by the compression of the spring. By appropriate selection and component sizing and weighting a fairly linear output proportional to the angular velocity of the engine can be obtained.

The slide rod 196 has an end 206 that acts as a push rod against one end of a rocker 208 pivotally mounted on a pivot pin 210. The rocker 208 is connected to the link 174 connecting the speed monitoring device to the output rod. A counter force spring 212 connected between a pin 214 on the double input lever 158 and an engine mounted hook 216, maintains the contact of slide rod 196 and rocker 208. The effect of higher engine r.p.m. will displace the input lever at pin 172 to the right. Demand for more power by the operator will displace the input lever at pin 155 to the left. When engine r.p.m. response is not equivalent to operator demand there will not simply be a pivot at pin 160 on input lever, but a displacement of output rod which effects a change in fuel supply by rotation of the cam 80.

The cam 80 is configured to lean out the fuel mixture as it rotates in a clockwise direction and richens the mixture when rotated in a counterclockwise direction. Although the contour shown is somewhat exaggerated, the cam is designed to gradually lean the mixture until a point is reached where further leaning will result in a too lean and uncombustible mixture. At this point on the cam, the contour abruptly inclines to an off condition.

To improve the practical operation of the r.p.m./demand mechanism 150, the connection of the arm 166 to the cam 80 is not direct, but by a pin 218 on the arm 166, which is pivotally connected to cam shaft 82 and an elongated slot 220 in the cam. Thus, as the cam is urged toward the limit of the lean mixture, if the crest of the abrupt incline to the off condition is reached, the degree of incline will allow the cam to slip the angular distance of the slot to an abrupt off condition, by-passing that condition where fuel is injected but not combusted. In this "off" condition, no fuel is supplied to the engine. In addition, the pin and slot connection is designed to avoid excessively abrupt changes in engine power when they are not needed or required. Where there are a plurality of cylinders in an engine and multiple hydraulic pump connected to the r.p.m./demand mechanism, the cam configuration or pin and slot location can be varied such that all pumps do not shut off the fuel supply at the same instant, but rather proceed in a staggered fashion. In this manner, there is a smooth change in power output spread over several hundred r.p.m. of engine operation or an equivalent level in power demand under operation control.

Several examples will be used to explain the operation of the r.p.m. vs. Demand System. Each of the examples will assume that the system is used operationally in an automobile, but the general principles that follow from each example can be applied to other applications.

EXAMPLE 1

The engine is running at about 60% of its maximum designed angular velocity. The accelerator pedal is depressed to about 60% of its full travel to overcome the air drag produced by high speed. The engine r.p.m. and power output are in good agreement with the desired power. The output rod 162 is therefore near its normal position and the cam 80 is oriented in a manner that provides the engine with a mixture ratio of about 14:1. This situation is shown in FIG. 3.

EXAMPLE 2

An automobile is traveling at high speed into a head wind and up a slight grade near the crest of a hill. The operator has depressed the accelerator to about 80% of its full travel to overcome the wind resistance and grade and still maintain his speed. Pin 155 is therefore very far to the left. Because of the high speed, pin 172 is far to the right. Pin 160 and rod 162 will be slightly to the left. This will produce a counter clockwise rotation of cam 80 from its normal position. The amount of fuel that is supplied to the engine will be increased and the mixture ratio will be made slightly rich as it should be to overcome the grade and wind resistance. As explained in the referenced U.S. Pat. No. 4,069,794, the eccentricity of the blower would also be increased under these conditions, which will produce a considerable increase in engine power output.

EXAMPLE 3

As the operator in example 2 comes over the crest of the hill he sees a truck blocking the road. He removes his foot from the accelerator pedal and hits the breaks. When the operator removes his foot from the accelerator pedal, pin 155 is pulled rapidly to the right by spring 156. Initially the engine is running at a high r.p.m. and pin 172 is far to the right. When pins 155 and 172 are both far to the right, pin 160 and rod 162 must also be far to the right, which will produce a large clockwise rotation of cam 80. The fuel supply to the engine will be temporarily cut off under these conditions. When the accelerator pedal was released, the eccentricity of the blower decreased, and the throttle atnthe intake of the blower closed. Under these conditions the angular velocity of the engine will decrease very rapidly.

EXAMPLE 4

The automobile in example 3 has stopped. The operator's right foot is on the brake and his left foot is on the clutch pedal. The engine is running at a low angular velocity. The eccentricity of the blower is near its minimum value, and the throttle at the intake of the blower has opened. The accelerator pedal is in its idle position. Pin 155 is very far to the right, and pin 172 is very far to the left. Therefore, pin 160 and rod 162 will be near their normal positions, and the cam 80 will be near its normal position. If the engine starts to run too fast the cam will move toward "lean" and slow the engine down. Conversely, if the engine runs to slowly the cam will move toward "rich" and increase the r.p.m. of the engine.

EXAMPLE 5

The truck in example 3 has been removed from the road, and the automobile can continue on its way. The operator is impatient and wishes to attain high speed as soon as possible (gear shifts, etc. will be ignored). The operator depresses the accelerator pedal as much as possible. This moves pin 155 to its extreme left position and also increases the eccentricity of the blower to its maximum value. Pin 172 will initially also be far to the left. Therefore pin 160 and rod 162 will be near their left limits. The cam 80 will be oriented to provide a rich fuel-air mixture, and the blower will supply a high volume of air. Therefore, a large amount of both air and fuel will be present in the combustion chamber during combustion. The effective compression ratio will also be increased by the high pressure (3–5 p.s.i.g.) air in the cylinder at the beginning of the compression stroke. The large amount of a rich fuel-air mixture and high compression ratio will provide very large torques. These very large output torques will produce rapid increases in r.p.m., power and speed.

The foregoing describes a mechanical system for generating the input for complex derivative signals, which is used to modulate fuel flow as a factor of the operator's demand. This input comprises one input for one of the control cylinders of the hydraulic pump. Other mechanical control systems are utilizeable to provide control cylinder inputs, such as the bellows mechanism described in the referenced patent for modulating fuel supply in response to changes in temperature and pressure of air supplied to the combustion chamber.

While mechanical systems have been shown and described in detail, as preferred embodiments, it is to be understood that equivalent electrical analog systems can be devised to substitute for certain mechanical input generators.

Figure 4:
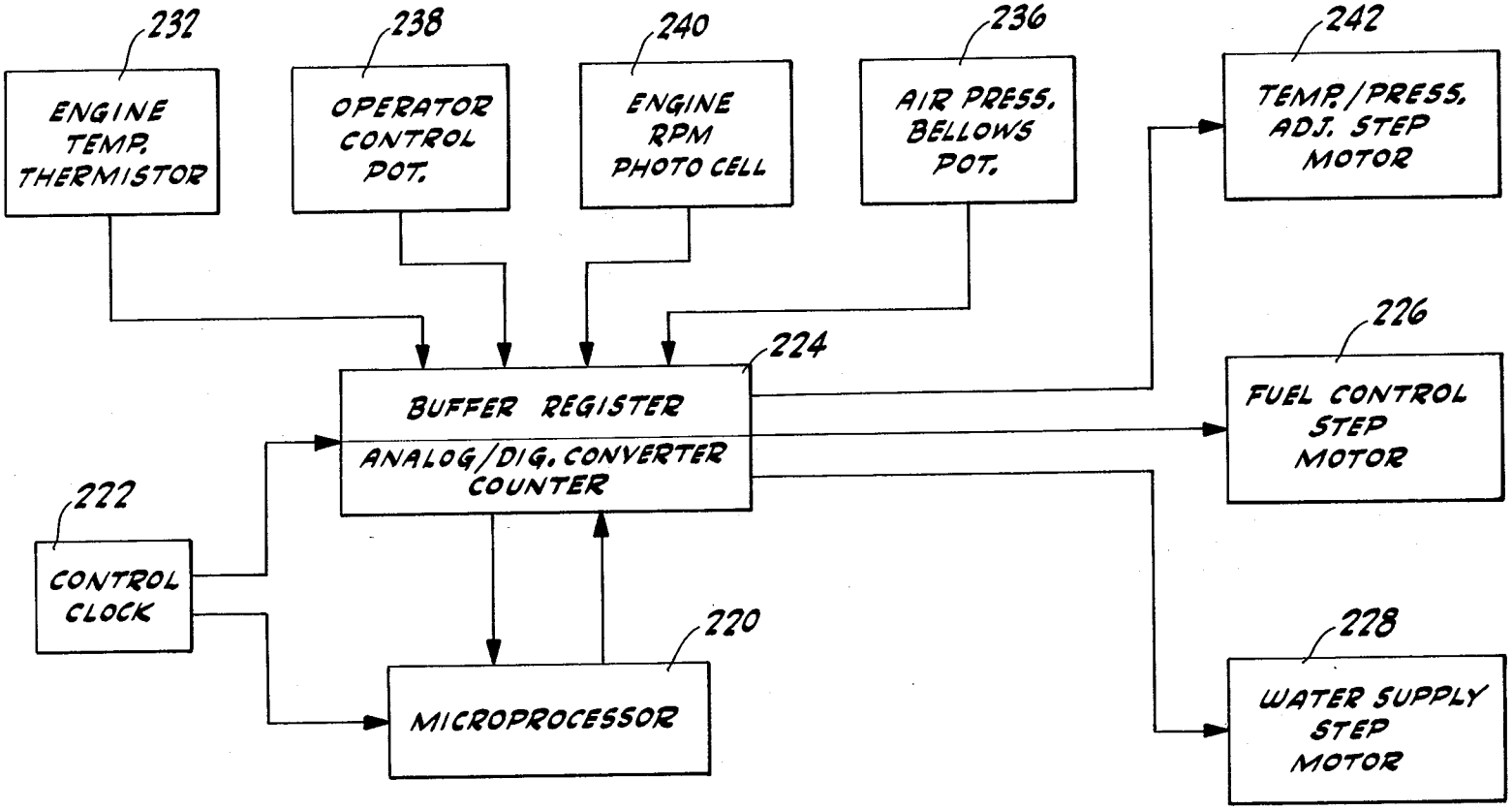
FIG. 4 is a block schematic of an electronic system for control of said pump mechanism.

A block schematic in FIG. 4 shows a generalized electronic system useable with a microprocessor. In the event that microprocessors assume more regulatory functions in automotive systems it would be an effective use of the microprocessor to assume certain tasks as described above that were accomplished by mechanical means.

In general, the engine must be equipped with sensors, input interfaces for each sensor, a micro-computer, an oscillator, output interfaces, drive components and various peripheral devices. There must be a sensor for each of the parameters that has a significant influence on the proper control of the engine. These parameters include:

The temperature of the air entering the cylinders;
The pressure of the air entering the cylinders;
The orientation of the crankshaft;
The orientation of the fuel and water control cams;
The temperature of the engine;
The power demand on the engine as indicated by by operator.

Each sensor must provide a signal that can be used to accurately determine the parameter associated with the sensor. Specific examples of satisfactory sensors will be described later.

The signals from the sensors will be electrical in nature. They may be either continuous or intermittant (pulses) and can vary considerably in magnitude. Also, the magnitude of the signal from any given sensor will in general not be an indication of its importance in the control problem. In some cases there may be an inverse relationship between the magnitude of the signal and the magnitude of the parameter of interest. The input interfaces process the signals from the sensors, and produce information which is compatible with the input requirements of the computer. The input interfaces will contain a variety of electrical and electronic circuits which may include attenuators, amplifiers, signal samplers, analog to digital converters, signal limiters, calibration adjustment, polarity reversal, pulse shaping, etc. The input interfaces accept analog or pulse signals and furnish the computer with appropriate digital information.

Potentiometers or adjustible resistors (trimmers) can be used in most of the sensors. In practical devices they are usually the same before they are connected to a circuit. They consist of a resistor and a contact that can be moved along the resistor. The devices usually have three terminals. There is a terminal at each end of the resistor and one connected to the adjustible contact. If a potential is applied to the entire resistor, e.g. a battery is connected to the terminals at the ends of the resistors, then the potential between one of the ends and the adjustment contact will be proportional to the fraction of the total resistance that is between the fixed and adjustible contact. These devices can also function as adjustible resistors when only one end contact and the adjustible contact are used. Potentiometers can have either linear or circular resistors and can therefore measure either linear motions or rotations. Also, very little force is required to move the adjustable contact in most potentiometers.

The air pressure sensor would consist of a linear potentiometer that is driven by a sealed air filled bellows. Rotational type potentiometers would be used to measure the orientation of the fuel and water control cams. The shaft of the potentiometer which controls the location of the adjustible contact would be connected to the control cam shaft. All of the control cams are connected to this shaft.

Another potentiometer would be used to indicate the desired power output from the engine. The adjustible contact in the potentiometer would be connected to the accelerator pedal.

The orientation of the crankshaft can be determined either directly or indirectly from the orientation of some other rotating shaft that is connected to the crankshaft by gears, chain and sprockets, etc. The sensor or sensors can consist of small magnets that are attached to the shaft and small coils with thin iron cores that are at fixed locations around the shaft. Sets of light emitting diodes and photo-diodes with a rotating mask between them can also be used to indicate orientation. If the computer is used to control ignition, a set of diodes can be provided for each cylinder by placing them at different positions around the axis of the shaft. Both types of sensor will produce short electrical pulses. These pulses would be shaped by the input interface and fed to the computer. The computer can calculate the angular velocity (r.p.m.) of the engine by dividing the number of input pulses from the shaft sensors by the number of time pulses from the oscillator during the same interval of time.

In the described engine the bellows would be replaced by a smaller bellows and potentiometer and a thermistor system. The small bellows and potentiometer would act as a pressure sensor. The thermistor system would indicate the air temperature. The functions performed by rods, levers, springs, etc., would be performed directly or indirectly by the computer and its interfaces.

The micro-computer contains logic circuits and built in programs for processing the input data and generating all required output information. The output information can include the correct times for ignition and any necessary changes in the orientation of control cams, valves, etc.

The oscillator performs at least two important functions. It provides a clock for the entire system particularly the computer. This allows the computer to calculate time dependent parameters such as angular velocities from a series of instantaneous orientations of a rotating component, e.g. the crankshaft. The oscillator also provides the pulses that are required by the analog to digital converters in the input interfaces. An analog to digital converter is essentially an electronic gate circuit that remains open for a time interval that is proportional to the magnitute of the analog signal. Pulses are fed to the gate at some fixed frequency. The number of pulses that get through the gate while it is open is therefore proportional to the magnitude of the analog signal.

The output interfaces use information from the computer and power from some other source to generate the electric currents, pulses, etc., that are required for proper operation of the control system. The output from the computer contains very little power. This output is also in digital form. Most of the drives in the control system require significant amounts of power for reliable operation. Therefore, the output interfaces will consist of various arrangements of power amplifiers, pulse generators and digital to analog converters.

The drive components of the system include the motors and solenoids that operate the control cams and valves. Stepping motors are very compatible with digital computers. These motors are driven by positive and negative electrical pulses of fixed amplitude and duration. Each pulse causes the motor shaft to rotate through a small angle. The amount of rotation per pulse is quite accurate. The polarity of the electrical pulse determines the direction of rotation.

The following sensors and input interfaces are useable with an engine as described herein and in the referenced patent.

Thermisters provide simple, accurate and inexpensive sensors for temperature measurements. Thermisters are solid state devices that are electrically equivalent to resisters with very large negative temperature coefficients, i.e. the resistance of a thermistor decreases by several percent when the temperature increases only a few degrees. When an electrical potential, e.g. battery, is included in a loop containing a thermistor, the current in loop will increase as the temperature increases. If the loop contains a resistor that is located in an input interface, then the voltage across this resistor will increase as the temperature increases. In practice the resistor in the interface would consist of two or more resistors including adjustable resistors and potentiometers for calibration and adjustment of signal size. The adjusted voltage would then be fed to an analog to digital converter in the interface. The digital indication of temperature would in turn be fed to the computer.

The components of the engine temperature system that adjusts water injection would be replaced by a thermistor sensor system, the computer with its interfaces and a drive system.

The hexagonal shaft which moves the fuel control cams and water control cams would be driven by a computer controlled stepping motor.

The r.p.m. meter would be replaced by sensors on or connected to the crankshaft, an oscillator, input interfaces and a computer. The functions performed by the rods, levers, springs, etc., would be performed by a computer. A potentiometer type sensor would be connected to the wire or rod that indicates the power desired by the engine's operator. Computer controlled solenoids or stepping motors would drive the fuel control cams. The rich-lean function of the r.p.m. vs. demand cams could be taken over by the temperature/pressure cams. When computer control is used for the on-off function, solenoids would be quite satisfactory for this on-off function.

The microprocessor 220 is a conventional type having logic circuitry and a random access memory for temporary storage of input data and internal operational data and a read only memory for storage of an operational program and other fixed data.

Intimately associated with the microprocessor 220 is a control clock 222 and a buffer register 224 which includes an analog/digital converter, a counter circuit and control circuitry for receiving input data and converting such data to a digital form useable by the microprocessor. The buffer register additionally includes amplifier circuitry for pass through of output information to drive output means such as the stepping motors 226, 228 and 242 operating the control cams on the fuel control and water control cylinders of the respective pumps.

Additional input information to the microprocessor includes the air pressure sensor 236 which converts a bellows displacement to an electrical analog signal by a potentiometer and a thermistor sensor 232 for detecting engine temperature and directly converting the detected temperature to an analog signal. Other temperatures, i.e. latent air temperature, air intake temperature, and water temperature, may be sensed and utilized for display to the operator or as an added input to system control.

The fuel control stepping motor is operated from multiple inputs. The power demand of the operation is manually indicated by an accelerator pedal which is connected to a potentiometer 238 to generate an electrical signal which is the analog of the demand. Contemporaneously, the engine r.p.m. is detected by a photoelectric cell or photodiode 240 and generates a pulsed count representative of the r.p.m. The buffer register receives such signals and converts them to digital form available for access and utilization by the microprocessor. The microprocessor utilizes its internal control program to generate a differential signal for use by an output stepping motor in regulating fuel supply. The electrical means essentially substitutes for the r.p.m./demand mechanism 150 of FIG. 3. Other inputs such as the temperature pressure inputs, 232 and 236, may control separate stepping motors 242 connected to cams driving separate control cylinders of the hydraulic pumps, or may be integrated into the r.p.m./demand output signal for adjustment of such signal prior to driving the fuel control cylinder.

While in the foregoing specification embodiments of the invention have been set forth in considerable detail for the purposes of making a complete disclosure of the invention, it should be apparent to those of ordinary skill in the art that numerous changes may be made in such details without departing from the spirit and principles of the invention.

What is claimed is:

1. An improved liquid injector system for combustion engines comprising:

a liquid pump mechanism having a liquid chamber with a reciprocal drive piston, said pump mechanism containing a drive liquid, and including a delivery conduit for said drive liquid;

means for connecting the reciprocal drive piston to a drive source for reciprocating said drive piston in said liquid chamber;

at least one control cylinder communicating with said liquid chamber, said control cylinder having a displaceable control piston for varying the effective volume of said liquid chamber and an input drive means operably connected to said control piston for displacing said control piston in said control cylinder in accordance with input variables, wherein periodic delivery of drive fluid in said delivery conduit is varied in accordance with displacement of said control piston in said control cylinder; and a liquid injector mechanism connected to a liquid source, the injector mechanism having an injector nozzle and a cylinder with a displaceable power piston separating a first liquid chamber on one side of said piston and a second liquid chamber on the other side of said piston, said first chamber being connected to said delivery conduit of said pump mechanism and said second chamber being connected to said liquid source and to said injector nozzle, wherein periodic delivery of drive liquid to said first chamber generates displacements in power piston forcing fluid from said supply source through said injector nozzle; wherein said injector nozzle has an annular divergent orifice of predetermined maximum size, said nozzle being constructed with an inner displaceable stem having a displacement stop and a conically divergent end and constructed with a fluid passage with an inner stop seat and with an outer divergent wall coincident with said conically divergent end, said stem including bias means for biasing said displacement stop away from said stop seat when fluid is not forced through said injector nozzle by said power piston, said displacement stop being displaceable against said stop seat during high pressure fluid injection, said orifice being formed between said divergent end of said stem and said divergent wall upon displacement of said stem and engagement of said stop wherein said orifice has a predefined limited discharge area for discharge of fluid in particulate spray upon injection.

2. An improved liquid injector system for combustion engines comprising:

a liquid pump mechanism having a liquid chamber with a reciprocal drive piston, said pump mechanism containing a drive liquid, and including a delivery conduit for said drive liquid;

means connecting the reciprocal drive piston to a drive source for reciprocating said drive piston in said liquid chamber;

at least one control cylinder communicating with said liquid chamber, said control cylinder having a displaceable control piston for varying the effective volume of said liquid chamber and an input drive means operably connected to said control piston for displacing said control piston in said control cylinder in accordance with input variables, wherein periodic delivery of drive fluid in said delivery conduit is varied in accordance with displacements of said control piston in said control cylinder; and wherein said input drive means comprises a differential control signal mechanism having means for generating a variable dynamic input signal analogous to a continuously variable manual power demand by an operator, means for generating a comparable input signal analogous to the engine speed of an associated combustion engines and means for generating a differential signal based on a difference of the variable input power demand signal and the engine speed signal, and said differential control signal mechanism having a displacement means engaging the control piston of said input drive means for displacing the control piston in accordance with the differential signal, wherein said displacement means of said differential control signal mechanism comprises a rotatable cam element having a cam surface engageable with said control piston of said input drive means for displacement of said control piston on rotation of said cam element.

3. An improved liquid injector system for combusting engines comprising:

a liquid pump mechanism having a liquid chamber with a reciprocal drive piston, said pump mechanism containing a drive liquid, and including a delivery conduit for said drive liquid;

means connecting the reciprocal drive piston to a drive source for reciprocating said drive piston in said liquid chamber;

at least one control cylinder communicating with said liquid chamber, said control cylinder having a displaceable control piston for varying the effective volume of said liquid chamber and an input drive means operably connected to said control piston for displacing said control piston in said control cylinder in accordance with input variables, wherein periodic delivery of drive fluid in said delivery conduit is varied in accordance with displacements of said control piston in said control cylinder; and wherein said input means comprises a differential control signal mechanism having means for generating a variable dynamic input signal analogous to a continuously variable manual power demand by an operator, means for generating a comparable input signal analogous to the engine speed of an associated combustion engines and means for generating a differential signal based on a difference of the variable input power demand signal and the engine speed signal, and said differential control signal mechanism having a displacement means engaging the control piston of said input drive means for displacing the control piston in accordance with the differential signal, said means for generating an input signal analogous to a manual power demand comprises a mechanical linking assembly with a first displaceable output element, the assembly being adapted for manipulation by a user; wherein said means for generating a comparable input signal analogous to the engine speed comprises a flyball type r.p.m. meter with a second displaceable output element; and, wherein said means for generating a differential signal comprises an interlinked differential mechanism interconnecting said first output element and said second output element, said differential mechanism being connected to said displacement means engaging said control piston.

4. The injector system of claim 2 wherein said rotatable cam element is connected to a rotation mechanism with connection means for allowing limited angular displacement of said rotation mechanism before rotation of said cam element.

5. The injection system of claim 4 wherein the control piston of said input drive means includes a cam element engagement surface and said cam surface of said cam element includes a surface portion having a relative inclination to said piston engagement surface causing free rotation of said cam element relative to said rotation mechanism when said portion of said cam surface in engagement with said piston engagement surface.

* * * * *